US009293837B2

(12) United States Patent
Chiu

(10) Patent No.: US 9,293,837 B2
(45) Date of Patent: Mar. 22, 2016

(54) WIRELESS COMMUNICATION APPARATUS

(71) Applicant: ASUSTek COMPUTER INC, Taipei (TW)

(72) Inventor: Min-Yuan Chiu, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 352 days.

(21) Appl. No.: 13/718,725

(22) Filed: Dec. 18, 2012

(65) Prior Publication Data

US 2013/0214990 A1 Aug. 22, 2013

(30) Foreign Application Priority Data

Feb. 21, 2012 (CN) ..... 2012 1 0040549

(51) Int. Cl.
*H01Q 21/00* (2006.01)
*H01Q 21/28* (2006.01)
*H01Q 1/22* (2006.01)

(52) U.S. Cl.
CPC ..... *H01Q 21/00* (2013.01); *H01Q 1/22* (2013.01); *H01Q 21/28* (2013.01)

(58) Field of Classification Search
CPC ..... H01Q 21/00; H01Q 21/061; H01Q 1/246; H01Q 1/38; H01Q 21/205
USPC ..... 343/893, 853, 702
See application file for complete search history.

(56) References Cited

U.S. PATENT DOCUMENTS

| | | | | |
|---|---|---|---|---|
| 4,916,460 | A * | 4/1990 | Powell | 343/853 |
| 5,379,455 | A * | 1/1995 | Koschek | 455/273 |
| 7,912,507 | B2 * | 3/2011 | Hashigami et al. | 455/562.1 |
| 8,325,632 | B2 * | 12/2012 | Gorbachov | 370/280 |
| 2008/0001837 | A1 | 1/2008 | Liu | |
| 2008/0062066 | A1 | 3/2008 | Arai | |
| 2010/0007564 | A1 * | 1/2010 | Hill et al. | 343/702 |
| 2011/0175789 | A1 * | 7/2011 | Lee et al. | 343/853 |

FOREIGN PATENT DOCUMENTS

| | | |
|---|---|---|
| CN | 101140635 A | 3/2008 |
| TW | 200805784 (A) | 1/2008 |

* cited by examiner

*Primary Examiner* — Huedung Mancuso
(74) *Attorney, Agent, or Firm* — Muncy, Geissler, Olds & Lowe, P.C.

(57) ABSTRACT

A wireless communication apparatus includes a first antenna, an antenna driving circuit, a first medium, a second medium, and a second antenna. The antenna driving circuit drives the first antenna. The first medium is electrically connected between the first antenna and the antenna driving circuit. The second medium and the first medium are in energy coupling. The second antenna is electrically connected with the second medium.

10 Claims, 2 Drawing Sheets

WIRELESS COMMUNICATION APPARATUS

CROSS REFERENCE TO RELATED APPLICATIONS

This Non-provisional application claims priority under 35 U.S.C. §119(a) on Patent Application No(s). 201210040549.4 filed in People's Republic of China on Feb. 21, 2012, the entire contents of which are hereby incorporated by reference.

BACKGROUND OF THE INVENTION

1. Field of Invention

The present disclosure relates to an electronic apparatus and, in particular, to a wireless communication apparatus.

2. Related Art

Wireless transmission has been widely applied to electronic products with broadband transmission function for satisfying customers' demands. Thus, the existing electronic products are mostly equipped with the wireless transmission function. In a wireless transmission system, an antenna is needed for transmitting and receiving electromagnetic waves. If the antenna is out of function, the wireless transmission system can not normally transmit or receive data. In other words, the antenna is an indispensable role in the wireless transmission.

If the position of the antenna is close to a metal body, the metal body will shield the antenna radiation so that the communication dead space, thereby decreasing the communication performance. However, many commercial products have metal appearances, which suffer the antenna transmission performance. In addition, if the antenna is damaged, the wireless communication apparatus will lose the communication function.

SUMMARY OF THE INVENTION

A wireless communication apparatus includes a first antenna, an antenna driving circuit, a first medium, a second medium, and a second antenna. The antenna driving circuit drives the first antenna. The first medium is electrically connected between the first antenna and the antenna driving circuit. The second medium and the first medium are in energy coupling. The second antenna is electrically connected with the second medium.

As mentioned above, the wireless communication apparatus of the disclosure includes a first antenna, a first medium, a second antenna and a second medium. When the signal transmission performance of the first antenna is bad or the first antenna is damaged, the feeding signal outputted from the antenna driving circuit can be transferred to the second antenna through the energy coupling between the first medium and the second medium, thereby utilizing the second antenna to transmit the signal. Accordingly, the wireless communication apparatus of this disclosure provides two transmission paths for the antenna signals. The first transmission path includes the antenna driving circuit, the first medium and the first antenna, and the second transmission path includes the antenna driving circuit, the first medium, the second medium and the second antenna. Thus, the transmission paths can be switched based on the actual circumstances, thereby improving the communication function of the wireless communication apparatus.

These and other features, aspects and advantages of the present invention will become better understood with regard to the following description, appended claims, and accompanying drawings.

DETAILED DESCRIPTION OF THE INVENTION

Figure 1:
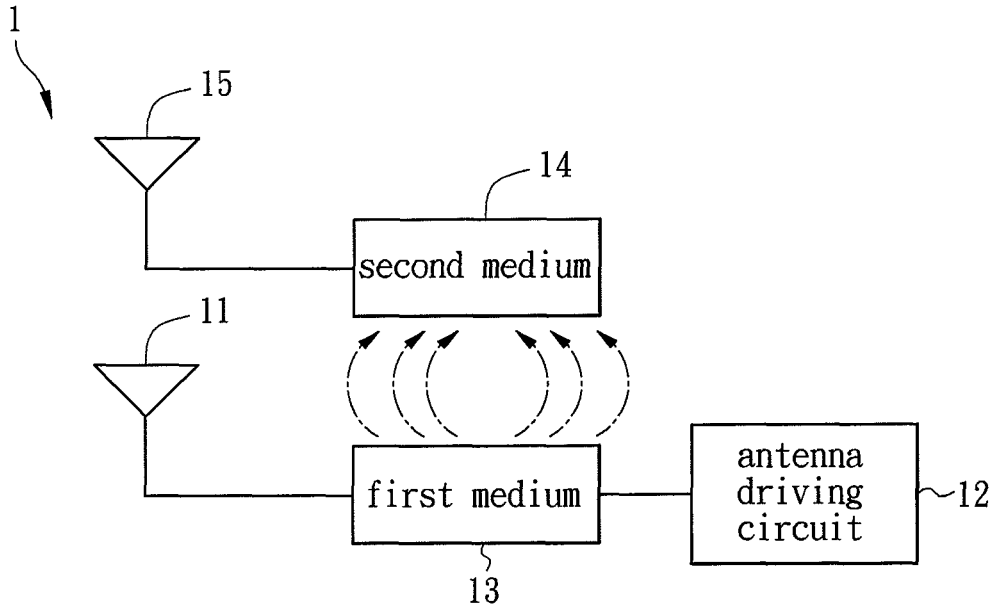
FIG. 1 is a block diagram showing a wireless communication apparatus according to a first embodiment of the disclosure.

FIG. 1 is a block diagram showing a wireless communication apparatus 1 according to a first embodiment of the disclosure. In this embodiment, the wireless communication apparatus 1 is a laptop computer. Of course, the wireless communication apparatus 1 may also be a TV, a computer (e.g. a tablet PC), a portable communication device (e.g. a mobile phone), or a network communication device (e.g. an access point).

The wireless communication apparatus 1 includes a first antenna 11, an antenna driving circuit 12, a first medium 13, a second medium 14 and a second antenna 15. The first antenna 11 and the second antenna 15 can be any kind of antenna such as a planar antenna, a solid antenna, a directional antenna or an omni-directional antenna. Besides, the operation frequency of this embodiment is not limited and it can be the working band of WLAN a/b/g/n, WiMAX and UWB.

The antenna driving circuit 12 is configured to drive the first antenna 11. The first medium 13 is electrically connected between the first antenna 11 and the antenna driving circuit 12. In this embodiment, the antenna driving circuit 12 is electrically connected with the first antenna 11 by a conductive unit, such as a coaxial transmission line. The first medium 13 is located between the conductive unit and the first antenna 11. The signal transmission distance of the first medium 13 and the first antenna 11 is specially designed, and is for example equal to ¼ of the operation wavelength of the first antenna 11. In the transmission line theory, it is an open loop from the view of the first medium. This configuration helps the energy coupling of the first medium 13 and the second medium 14.

The first medium 13 and the second medium 14 are in energy coupling. In general, the materials of the first medium 13 and the second medium 14 are selected to enable the energy coupling therebetween. For example, the materials of the first medium 13 and the second medium 14 are ceramic or microwave material (e.g. Duroid). The energy coupling effect between the first medium 13 and the second medium 14 is relative to the distance therebetween. For example, when the distance between the first medium 13 and the second medium 14 is shorter, the intensity of the energy coupling is stronger. Besides, the second antenna 15 is electrically connected with the second medium 14.

The wireless communication apparatus 1 of this disclosure provides two transmission paths for the antenna signals. The first transmission path includes the antenna driving circuit 12, the first medium 13 and the first antenna 11, and it is applied to transmit or receive antenna signals in the normal circumstance. The second transmission path includes the antenna driving circuit 12, the first medium 13, the second medium .14 and the second antenna 15, and it is applied to transmit or receive antenna signals in the special circumstance (e.g. the transmission performance of the first antenna 11 is bad or the antenna is damaged). In the second transmission path, the second antenna 15 can replace the first antenna 11 to transmit or receive signals due to the energy coupling between the first medium 13 and the second medium 14.

The two transmission paths can be switched based on the actual circumstances, thereby improving the communication function of the wireless communication apparatus. Of course, the disclosure is not limited to this (two transmission paths), and it is possible to configure more antennas and media for building more transmission paths.

Figure 2:
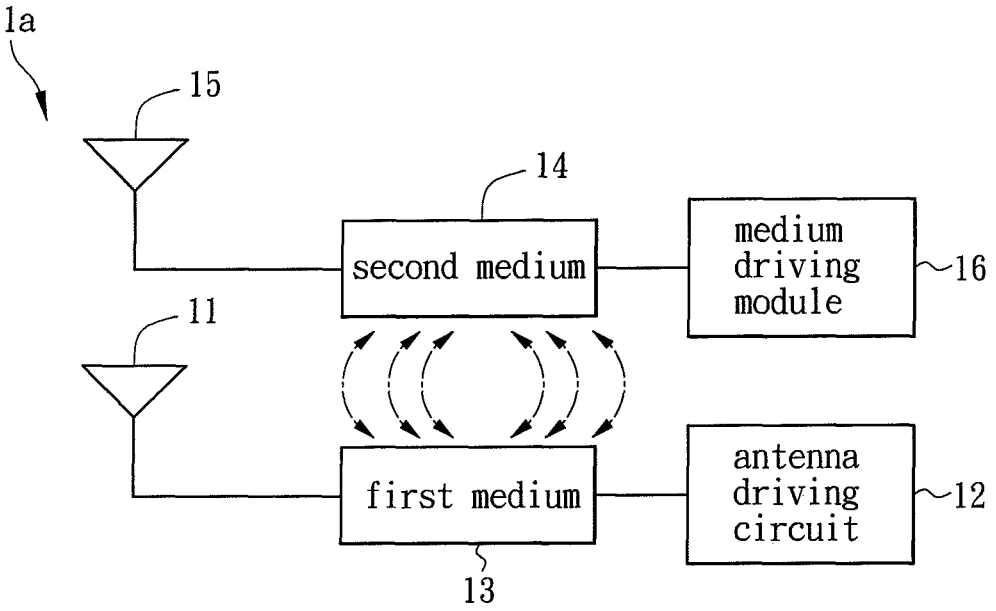
FIG. 2 is a block diagram showing a wireless communication apparatus according to a second embodiment of the disclosure.

FIG. 2 is a block diagram showing a wireless communication apparatus 1*a* according to a second embodiment of the disclosure. Different from the first embodiment, the wireless communication apparatus 1*a* further comprises a medium driving module 16, which is connected with the second medium 14 for driving the second medium 14 to move toward or away from the first medium 13. When the distance between the first medium 13 and the second medium 14 is smaller than a default value, the energy coupling between the first medium 13 and the second medium 14 is enabled, or the energy coupling intensity is sufficiently increased. The medium driving module 16 may include several actuators such as motors, gears, belts or the likes.

Figure 3:
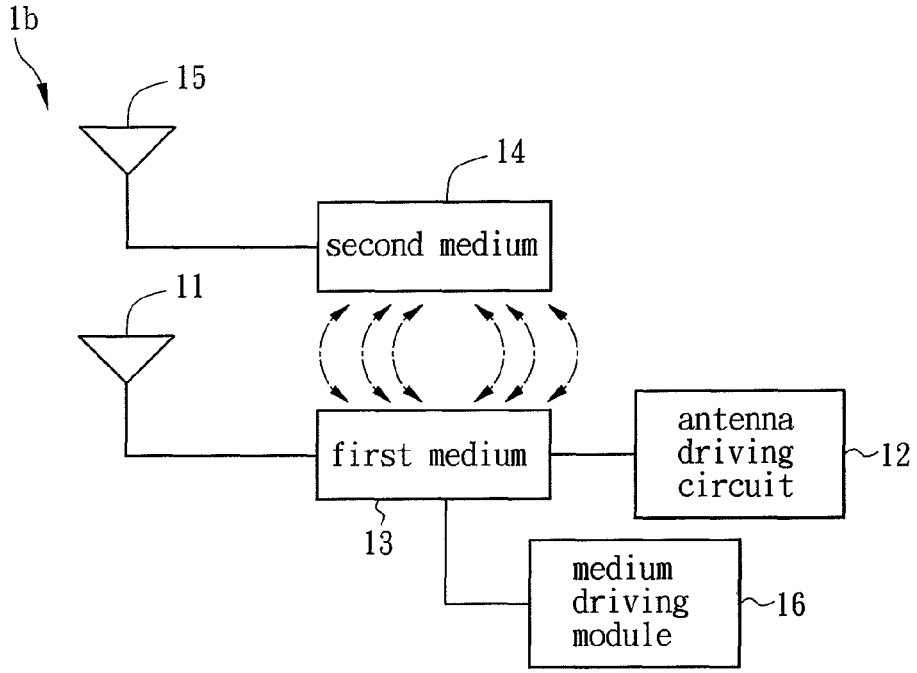
FIG. 3 is a block diagram showing a wireless communication apparatus according to a third embodiment of the disclosure.

FIG. 3 is a block diagram showing a wireless communication apparatus 1*b* according to a third embodiment of the disclosure. Different from the second embodiment, the medium driving module 16 is connected with the first medium 13 for driving the first medium 13 to move toward or away from the second medium 14. Otherwise, it is also possible to combine both of the features of the second and third embodiments so that the first medium 13 and the second medium can be independently moved.

Figure 4:
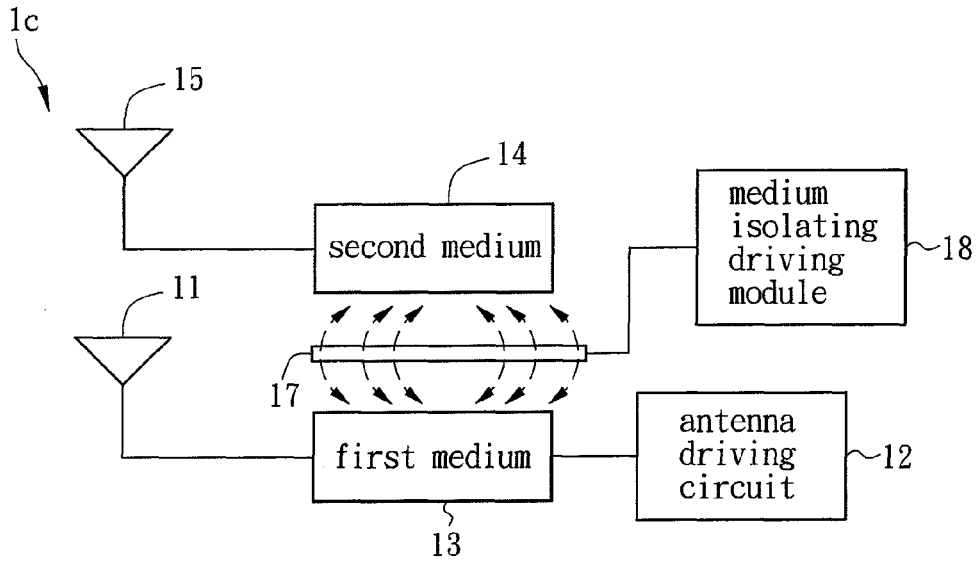
FIG. 4 is a block diagram showing a wireless communication apparatus according to a fourth embodiment of the disclosure.

FIG. 4 is a block diagram showing a wireless communication apparatus 1*c* according to a fourth embodiment of the disclosure. Different from the above embodiments, the wireless communication apparatus 1*c* further comprises a medium isolating element 17 disposed between the first medium 13 and the second medium 14 for blocking the energy coupling between the first medium 13 and the second medium 14. Moreover, the wireless communication apparatus 1*c* further comprises a medium isolating driving module 18 for driving the medium isolating element 17 to move. When the medium isolating element 17 is moved to the position between the first medium 13 and the second medium 14, the energy coupling between the first medium 13 and the second medium 14 is terminated. Alternatively, when the medium isolating element 17 is removed from the position between the first medium 13 and the second medium 14, the energy coupling between the first medium 13 and the second medium 14 is enabled.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A wireless communication apparatus, comprising:
a first antenna;
an antenna driving circuit driving the first antenna;
a first medium electrically connected between the first antenna and the antenna driving circuit;
a second medium, wherein the first medium and the second medium are in energy coupling; and
a second antenna electrically connected with the second medium,
wherein a first transmission path is formed by the antenna driving circuit, the first medium and the first antenna, and a second transmission path is formed by the antenna driving circuit, the first medium, the second medium and the second antenna.

2. The wireless communication apparatus of claim 1, wherein the antenna driving circuit is electrically connected with the first antenna by a conductive unit.

3. The wireless communication apparatus of claim 2, wherein the conductive unit is a coaxial transmission line.

4. The wireless communication apparatus of claim 2, wherein the first medium is located between the conductive unit and the first antenna.

5. The wireless communication apparatus of claim 1, wherein the signal transmission distance of the first medium and the first antenna equals to ¼ of the operation wavelength of the first antenna.

6. The wireless communication apparatus of claim 1, further comprises:
a medium driving module connected with the second medium for driving the second medium to move toward or away from the first medium.

7. The wireless communication apparatus of claim 1, further comprises:
a medium driving module connected with the first medium for driving the first medium to move toward or away from the second medium.

8. The wireless communication apparatus of claim 1, further comprises:
a medium isolating element disposed between the first medium and the second medium for blocking the energy coupling between the first medium and the second medium.

9. The wireless communication apparatus of claim 8, further comprises:
a medium isolating driving module for driving the medium isolating element to move.

10. A wireless communication apparatus, comprising:
a first antenna;
an antenna driving circuit driving the first antenna;
a first medium electrically connected between the first antenna and the antenna driving circuit;
a second medium, wherein the first medium and the second medium are in energy coupling;
a medium isolating element disposed between the first medium and the second medium for blocking the energy coupling between the first medium and the second medium; and
a second antenna electrically connected with the second medium.

* * * * *